US005638700A

United States Patent [19]

Shechter

[11] Patent Number: 5,638,700

[45] Date of Patent: Jun. 17, 1997

[54] EARRING POST

[76] Inventor: Jaime Shechter, 330 Meehan Ave., Far Rockaway, N.Y. 11691

[21] Appl. No.: 583,988

[22] Filed: Jan. 11, 1996

[51] Int. Cl.[6] ..... A44C 7/00

[52] U.S. Cl. ..... 63/12; 63/13

[58] Field of Search ..... 63/12, 13, 20; 24/499, 546

[56] References Cited

U.S. PATENT DOCUMENTS

| | | | |
|---|---|---|---|
| 180,887 | 8/1876 | Jeanne . | |
| 276,993 | 5/1883 | Arnold . | |
| 280,726 | 7/1883 | Dutemple . | |
| 298,611 | 11/1884 | Saraga . | |
| 320,991 | 6/1885 | Wescott . | |
| 397,434 | 2/1889 | Krug | 63/13 |
| 2,365,520 | 12/1944 | Bogue | 24/546 X |
| 2,948,936 | 8/1960 | Winthrop . | |
| 3,260,068 | 7/1966 | Micallef . | |
| 3,446,033 | 5/1969 | Driscoll . | |
| 4,214,456 | 7/1980 | Hannum . | |
| 4,221,118 | 9/1980 | Chicckine . | |
| 4,249,393 | 2/1981 | Ciambra . | |
| 4,497,186 | 2/1985 | Mason . | |
| 4,510,772 | 4/1985 | Alley et al. . | |
| 4,580,417 | 4/1986 | Sardelli . | |
| 4,741,179 | 5/1988 | McConnell, Jr. . | |
| 5,018,365 | 5/1991 | Luceno . | |
| 5,074,128 | 12/1991 | Kowalski . | |

FOREIGN PATENT DOCUMENTS

| | | |
|---|---|---|
| 1712 | of 1885 | United Kingdom . |
| 809579 | 2/1959 | United Kingdom . |

*Primary Examiner*—Kien T. Nguyen
*Attorney, Agent, or Firm*—Helfgott & Karas, P.C.

[57] ABSTRACT

A claspless or backless earring post is formed with a pair of wire portions interconnected by a substantially full 360 degree spiral or looped portion. The pair of wire portions may be aligned along a common axis which passes through or is offset above the center of an ornament. If offset, the post can resist high pull out forces created by heavy ornaments and can also maintain an ornament in a predetermined orientation on the ear.

19 Claims, 2 Drawing Sheets

EARRING POST

BACKGROUND OF THE INVENTION

1. Field of the Invention

The present invention relates in general to a self securing earring post which eliminates the need for a separate post retaining clasp and relates in particular to an earring post having a substantially full turn spiral formed between a pair of generally straight post sections.

2. Description of Prior Developments

Earring posts for pierced ears and the like have been in use for many years. Such posts typically include a wire shank portion which extends through an ear lobe and projects outwardly from the back side of the ear. The earring which is attached to the post is held in place against the front of the ear with a complementary fastener which clasps the post on the back side of the ear. A common drawback to such two-piece mountings is the misplacement or loss of the fastener which engages the post.

In order to eliminate the need for separate detachable post fasteners, earring posts have been designed with various bends and loops for hooking an earring in place without the aid of a separate clasp or fastener. Although these one-piece posts function satisfactorily in general, they are typically difficult to insert through the ear lobe and difficult to manipulate into final position.

Moreover, such claspless earring posts do not always function properly when relatively heavy ornaments are attached to the posts. That is, heavy earring ornaments tend to distort the ear lobes and cause the earring posts to shift and twist under the weight of the ornaments. In some cases, an earring post can actually be worked out of engagement with the ear and result in the loss of an earring.

Accordingly, a need exists for a unitary or one-piece earring post which is easy to attach and secure to one's ear.

Another need exists for such an earring post which is particularly adapted for supporting heavy ornaments without the risk of loss.

Still another need exists for a one-piece claspless earring post which can hold a heavy ornament in a predetermined orientation on one's ear.

SUMMARY OF THE INVENTION

The present invention has been developed to fulfill the needs noted above and therefore has as an object the provision of a claspless earring post which is easy to insert and attach to an ear or the like.

Another object of the invention is the provision of a one-piece or claspless earring or jewelry post which positively secures an ornament to an ear lobe and maintains the ornament in a predetermined position with respect to both the ear lobe and the post.

These and other objects are met by the present invention which is directed to a claspless earring post which is easy to insert and which provides a secure mounting for an earring. The post may be mounted to an ornament in a particular asymmetrical orientation to ensure a secure mounting of heavy ornaments.

The post may be attached to an ornament in conventional fashion through a base, frame or setting to which a stem portion of the post is secured. The post initially extends outwardly and generally perpendicularly from the base or with a slight twist or curl from the base and leads into a looped or coiled portion. After a full turn of the loop, the post leads into a free end portion which is aligned generally coaxially with the stem portion. The free end portion may be rounded at its tip to facilitate insertion of the post through an ear lobe.

In the event that an earring ornament is not spherical or is heavy, the earring post of the present invention should be offset from the center of the earring ornament such that the central looped portion of the post extends outwardly away from the center of the earring. In this manner, the looped portion provides a counterbalance against the weight of the earring such that the ornament is not only prevented from sagging on the ear, it is also maintained in a predetermined orientation with respect to the ear.

The aforementioned objects, features and advantages of the invention will, in part, be pointed out with particularity, and will, in part, become obvious from the following more detailed description of the invention, taken in conjunction with the accompanying drawings, which form an integral part thereof.

BRIEF DESCRIPTION OF THE DRAWINGS

In the drawings.

In the various figures of the drawings, like reference characters designate like parts.

DETAILED DESCRIPTION OF THE PREFERRED EMBODIMENTS

Figure 1:
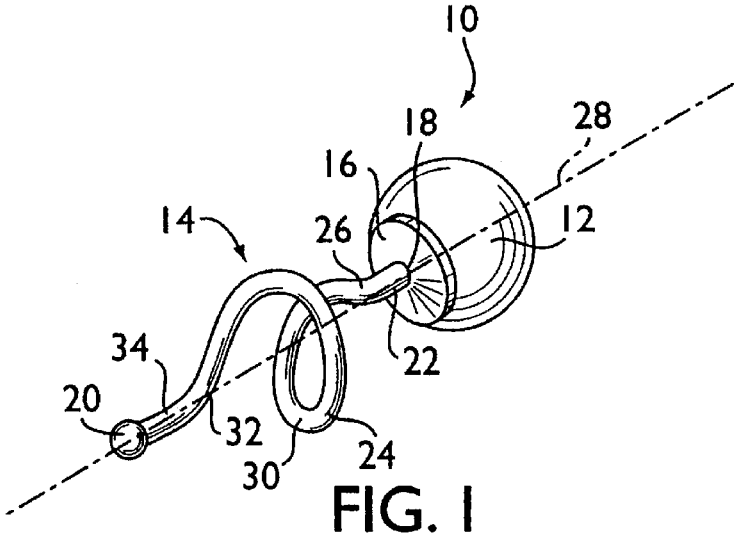
FIG. 1 is a rear perspective view of an earring post and ornament constructed in accordance with the present invention.
Figure 2:
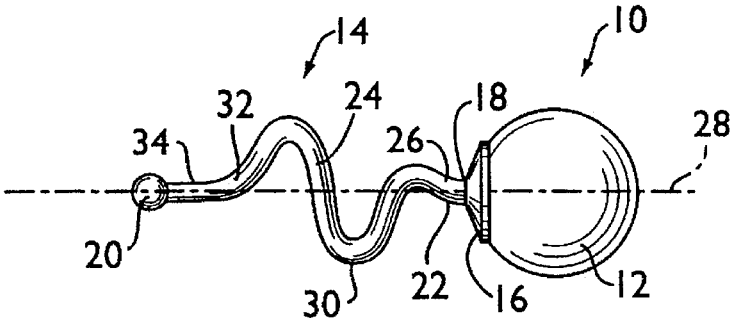
FIG. 2 is a right side view of FIG. 1.
Figure 3:
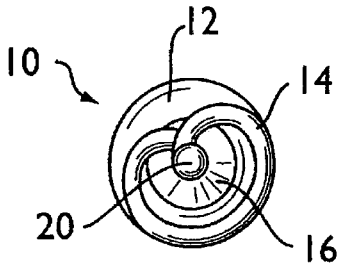
FIG. 3 is an axial rear end view of FIG. 1.

The present invention will now be described in conjunction with the drawings, beginning with FIGS. 1, 2 and 3 which show a one-piece or unitary earring 10 constructed in accordance with the invention. Earring 10 is of the claspless type which does not require any additional clasp or fastener to anchor the earring to an ear lobe.

Earring 10 includes an ornament 12 such as a pearl or virtually any other earring ornament. An earring post 14 formed of wire of the like is attached to the ornament 12 via base 16. Post 14 may be rigidly bonded to base 16 in conventional fashion by a weld such as by a brazed or soldered joint 18. Base 16 may be connected to the ornament 12 in a known fashion such as by an adhesive bond.

In order to facilitate insertion of the earring post 14 into a pierced ear, the tip of the free end of post 14 may be rounded or formed with a spherical bead 20 which prevents the post from sticking against and within the pierced portion of the ear lobe. Bead 20 also provides comfort to the wearer during insertion of the post because, as described further below, the post 14 must be twisted or rotated during insertion.

Post 14 includes a gently curling, almost linear stem portion 22 which extends axially rearwardly from base 16. The stem portion 22 leads into a looped or coiled portion 24 which begins at a first bend portion 26. In order to provide a comfortable fit within the ear lobe, the stem portion 22 should have an axially projected length, that is a distance along axis 28, of between about 0.5 mm and 2.3 mm.

In this first embodiment, the stem portion 22 of post 14 extends generally axially along axis 28 which passes close to or through the center and centroid of ornament 12. In FIG. 1, the ornament 12 is shown as a sphere, such as a pearl, and in this case axis 28 passes through the center of the sphere along a diameter thereof. Stem portion 22 extends rearwardly and initially generally perpendicularly from the center portion of base 16.

At first bend portion 26, the post 14 begins to spiral radially outwardly and rearwardly from axis 28. At point 30, the coiled portion 24 completes a full half loop of 180 degrees from bend portion 26. At this point, which is located at the approximate midpoint of coiled portion 24, the axial distance along axis 28 between joint 18 and point 30 should be between 2.3 mm and 5.0 mm.

This distance of 2.3 to 5.0 mm represents the axial distance over which a typical ear lobe will extend along post 14 when post 14 is properly and fully mounted on the ear. If this spacing is greater, the earring 10 will fit against the ear too loosely and if this spacing is less, the earring will fit too tightly against the ear.

Coiled portion 24 continues to spiral rearwardly around axis 28 from half loop point 30 at a generally constant radial distance from axis 28 and then spirals radially inwardly toward axis 28. The radial projection of the outer diameter of coiled or looped portion 24 as measured radially from axis 28 should be maintained between about 3.5 mm and 7.0 mm. This dimension determines the length and surface area of contact between post 14 and the ear lobe. This contact against the ear lobe in turn determines the frictional resistance against movement between the post and ear.

A full 360 degree spiral of coiled portion 24 is completed at a second bend portion 32 where the post 14 intersects axis 28. The axial distance along axis 28 between point 30 and the second bend portion 32 should be maintained between 3.0 mm and 5.0 mm to ensure a comfortable and secure fit of the forwardly facing radial surfaces of looped portion 24 against the back of the ear.

The post 14 continues to extend rearwardly from the second bend portion 32 along axis 28 and terminates at bead 20. In this manner, a generally straight portion is defined at the free end portion 34 of post 14 between bend 32 and bead 20. At least a portion of the straight free end portion 28 is aligned substantially colinearly and coaxially along common axis 28 which passes through the central inner portion of the coiled portion 24 and passes through at least a portion of the stem portion 22.

The axial length of the free end portion 34 should be maintained between 2.3 mm and 4.5 mm. If longer, the post could reach the wearer's neck area and become uncomfortable. If shorter, the post could become difficult to maneuver during insertion into a pierced ear. The pitch or rate of spiral of coiled portion 24 may be maintained substantially constant or may vary along axis 28.

In the event a non-spherical, non-round, asymmetrical or particularly heavy ornament 12 is to be properly connected to an earring post 14, it has been found desirable to offset axis 28 from the center or centroid of the ornament. That is, the weight of the ornament can cause the ear lobe to deflect inwardly toward the neck region thereby resulting in an axial component of force acting on post 14 and tending to pull the post outwardly and downwardly from the ear. The offset of axis 28 above the center of gravity of the ornament, together with the loop extending above this axis, counterbalances this force and is also particularly advantageous in those cases where the ornament 12 lacks symmetry or is designed to be worn with a specific orientation on the ear.

For example, as shown in FIGS. 4 through 8, an asymmetrical ornament 12 in the shape of a heart is connected to a post 14 which is constructed similar to the post 14 as described above and maintained within the same general dimensional ranges as specified above. In this example, base 16 is in the form of a conventional setting crimped around the faceted edge of a heart shaped diamond. Heart 12 is intended to be mounted on an ear with its bottom tip 36 pointed downwardly toward the ground, as is usual.

In order to ensure this preferential or predetermined orientation of the heart, substantially the entire extent of post 14 is aligned above an axis 38, which is analogous to axis 28 noted above, and which passes through the approximate center or centroid 39 of heart ornament 12 and substantially perpendicular to the rear surface 40 of base 16. That is, post 14 should be aligned so that its stem 22 is connected to base 16 adjacent to the center of top portion 42 of ornament 12. The axis 44 of stem 22 should extend directly above centroid 39, generally parallel to axis 38, and pass through the bottom outer radial portion of loop 24 at a point diametrically opposite to point 30. The maximum radial offset of loop 24 from its axis 44 is at point 30. Both axes 38 and 44 are intended to be aligned substantially perpendicular with respect to the front and rear surfaces of an ear lobe when earring 10 is secured to an ear.

Figure 4:
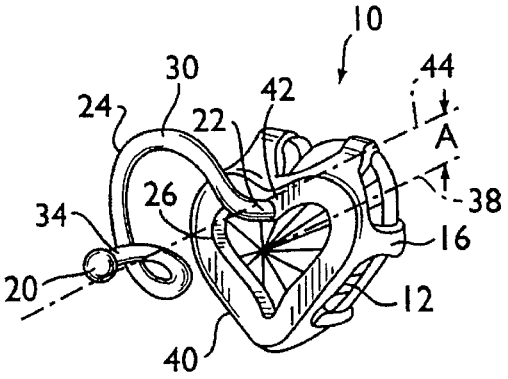
FIG. 4 is a rear perspective view of an earring post and ornament constructed in accordance with a second embodiment of the invention.
Figure 5:
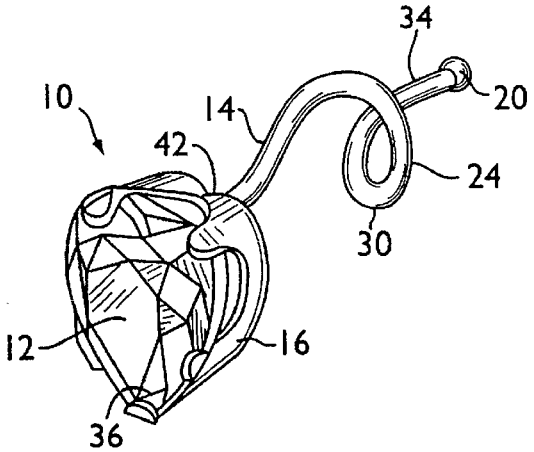
FIG. 5 is a front perspective view of FIG. 4.
Figure 6:
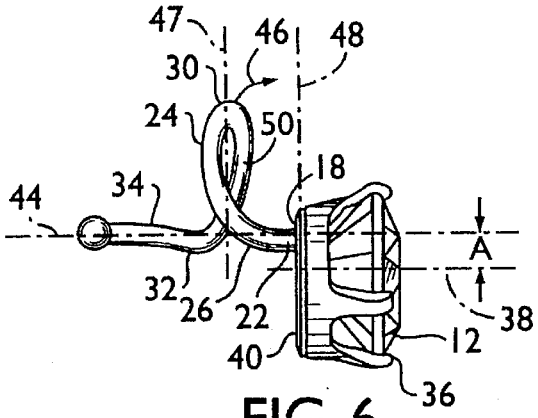
FIG. 6 is a right side view of FIG. 4.
Figure 7:
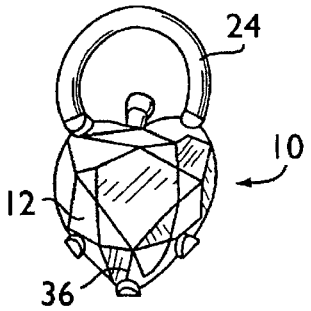
FIG. 7 is a front view of FIG. 4.
Figure 8:
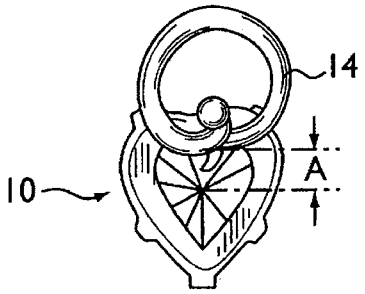
FIG. 8 is a rear axial view of FIG. 4.

It can be appreciated that by offsetting the entire post 14 by a distance A above centroid 39 as shown in FIGS. 4 and 6, and by connecting the post 14 to the central top portion 42 of base 16, the weight of ornament 12 will force the central coiled portion 24 generally upwardly in a slight clockwise pivoting movement against the rear surface of the ear in the general direction of arrow 46 in FIG. 6. This results in a balance of moments on opposite sides of the ear which securely maintains the earring 10 in a predetermined position on the ear.

That is, the tip 36 of ornament 12 will be fixed on the ear in a substantially downwardly directed orientation. This orientation will also minimize the component of force acting along axis 44 tending to pull the post 14 outwardly and downwardly from the ear.

In each of the embodiments discussed above, the mounting of post 14 to an ear lobe is accomplished by pushing the free end portion 34 directly, i.e. straight, into an ear lobe, that is, perpendicular to the outer surface of the ear. It has been found that this 90 degree angle of insertion is quite easy to accomplish as compared to other earring posts having curved ends which must be hooked or looped through the ear.

Once the earring post encounters axial resistance, it is rotated in the manner of a corkscrew until the looped portion 24 is screwed securely against the back of the ear. In this manner, the ornament is held securely against the outer surface of the ear without the need for applying a supplemental clasp to post 14.

The friction between the looped portion 24 and the back of the ear prevents the post 14 from twisting loose. Moreover, the relative position of the looped portion 24 with respect to the base 16 and ornament 12 ensures that ornament 12 will be secured in a predetermined orientation insofar as the final rotated position of post 14 is predetermined by the extent of engagement and pressure between looped portion 24 and the rear surface of the ear. By dimensioning the post 14 within the limits noted above, a simple 360 degree turn will ensure both proper orientation of the ornament 12 and a secure and comfortable fit against the ear.

That is, all that is required to fit earring 10 to an ear is a 360 degree rotation of post 14 to properly anchor and orient the ornament 12 with the looped portion 24 of post 14 extending upwardly above centroid 39 and the tip portion 36 disposed downwardly at a position directly below centroid 39. Removal is equally easy by pulling and twisting post 14 in the direction opposite to that of insertion.

As shown in FIG. 6, the looped portion 24 of post 14 is aligned substantially along a plane 47 which is generally parallel to plane 48 within which the rear surface 40 of base 16 is disposed. This plane 47 and loop 24 also extend radially above and generally perpendicular to axis 38. In this manner, the front surface 50 of loop 24 is aligned so as to lie generally flatly against the rear surface of the ear lobe. This not only ensures the most effective counterbalance against the weight of ornament 12, but also provides the greatest support and comfort to one's ear.

There has been disclosed heretofore the best embodiment of the invention presently contemplated. However, it is to be understood that various changes and modifications may be made thereto without departing from the spirit of the invention. For example, post 14 may be directly attached to or inserted within ornament 12 without using base 16.

What is claimed is:

1. An earring post, comprising:

a stem portion;

a free end portion, and a coiled portion located between and interconnecting said stem portion and said free end portion, said stem portion and said free end portion extending at least in part along a substantially common axis and wherein said coiled portion comprises a substantially full 360 degree, continuous turn defining a full loop.

2. The post of claim 1, wherein said axis extends through an outer radial portion of said coiled portion.

3. An earring, comprising:

an ornament;

a base attached to said ornament; and an earring post rigidly connected to said base, said earring post comprising a stem portion having an axis extending substantially axially from said base, a looped portion extending radially outwardly from said axis over a first half loop to a midpoint and radially inwardly from said midpoint toward said axis over a second half loop, and a free end portion extending axially from said looped portion to a free end tip, said looped portion being radially offset from said stem portion and said free end portion and having a maximum radial offset at said midpoint.

4. The earring of claim 3, wherein said looped portion comprises a substantially full 360 degree, continuous loop.

5. The earring of claim 3, wherein said loop comprises a spiral loop.

6. The earring of claim 3, wherein said stem portion and said free end portion are aligned at least in part along a common axis.

7. The earring of claim 3, wherein said ornament comprises a centroid and wherein said stem portion is aligned along an axis which passes approximately through said centroid.

8. The earring of claim 3, wherein said ornament comprises a centroid and wherein said stem portion is aligned along an axis which is substantially offset from said centroid.

9. The earring of claim 3, wherein said ornament comprises a top portion and a bottom portion and wherein said stem portion is mounted to said ornament adjacent said top portion.

10. The earring of claim 3, wherein said stem portion has an axial length of between 0.75 mm and 2.3 mm.

11. The earring of claim 3, wherein the axial distance from said base to said midpoint is between 2.3 mm and 5.0 mm.

12. The earring of claim 3, wherein said looped portion comprises a diameter of between 3.5 mm and 6.0 mm.

13. The earring of claim 3, wherein said looped portion comprises a midpoint and said post further comprises a bend portion located between said looped portion and said free end portion and wherein the axial distance between said midpoint and said bend portion is between 3.0 mm and 5.0 mm.

14. The earring of claim 3, wherein said free end portion has an axial length of between 2.3 mm and 4.5 mm.

15. An earring, comprising:

an ornament comprising a front surface portion, a rear surface portion, a top portion, a bottom portion, a centroid located centrally between said front, rear, top and bottom portions and an axis passing through said front and rear surface portions and said centroid; and an earring post having a stem portion connected to said ornament adjacent said top portion and above said centroid and said stem having an axis radially spaced from and generally parallel to said axis passing through said centroid.

16. The earring of claim 15, wherein said post comprises a looped portion extending generally parallel to said rear surface portion.

17. The earring of claim 15, wherein said post comprises a looped portion having one end connected to said stem portion, and a free end portion connected to an opposite end of said looped portion.

18. The earring of claim 17, wherein said stem portion and said free end portion are aligned at least in part along a common axis.

19. The earring of claim 18, wherein said free end portion comprises a rounded tip.

* * * * *